United States Patent [19]

Baxter

[11] 4,011,124

[45] Mar. 8, 1977

[54] APPARATUS FOR CONTINUOUS HOT AIR BONDING A NONWOVEN WEB

[75] Inventor: James Fletcher Baxter, Hendersonville, Tenn.

[73] Assignee: E. I. Du Pont de Nemours and Company, Wilmington, Del.

[22] Filed: July 9, 1975

[21] Appl. No.: 594,283

[52] U.S. Cl. ..... 156/358; 34/115; 34/118; 156/181; 156/382; 156/433; 156/494; 156/497; 156/499; 226/195

[51] Int. Cl.[2] ..... F26B 11/18; D04H 3/12

[58] Field of Search ..... 156/181, 290, 296, 306, 156/161, 163, 164, 382, 358, 497, 494, 499, 433, 381, 311, 166; 19/161 P; 428/296; 34/23, 115, 49, 111, 116, 118; 226/195

[56] References Cited

UNITED STATES PATENTS

| | | | |
|---|---|---|---|
| 3,345,756 | 10/1967 | Bryand et al. | 34/23 |
| 3,574,261 | 4/1971 | Bailey | 34/23 |
| 3,617,417 | 11/1971 | Olson | 156/181 |
| 3,771,236 | 11/1973 | Candor et al. | 34/23 |
| 3,800,364 | 4/1974 | Halwaites | 19/161 P |
| 3,811,988 | 5/1974 | Fleissner | 34/115 |

*Primary Examiner*—Charles E. Van Horn
*Assistant Examiner*—Michael W. Ball

[57] ABSTRACT

A nonwoven web of thermoplastic filaments is thermally bonded by conveying the web on a rotating hollow cylindrical roll having a pervious surface and passing hot air through the web into the roll to heat the filaments to the bonding temperature. The web is restrained against the roll surface with a stationary porous fabric under pressure developed by flow of the hot air through the fabric. Means for adjusting the length of fabric in contact with the web, and for measuring tension on the fabric, are provided in the apparatus.

1 Claim, 1 Drawing Figure

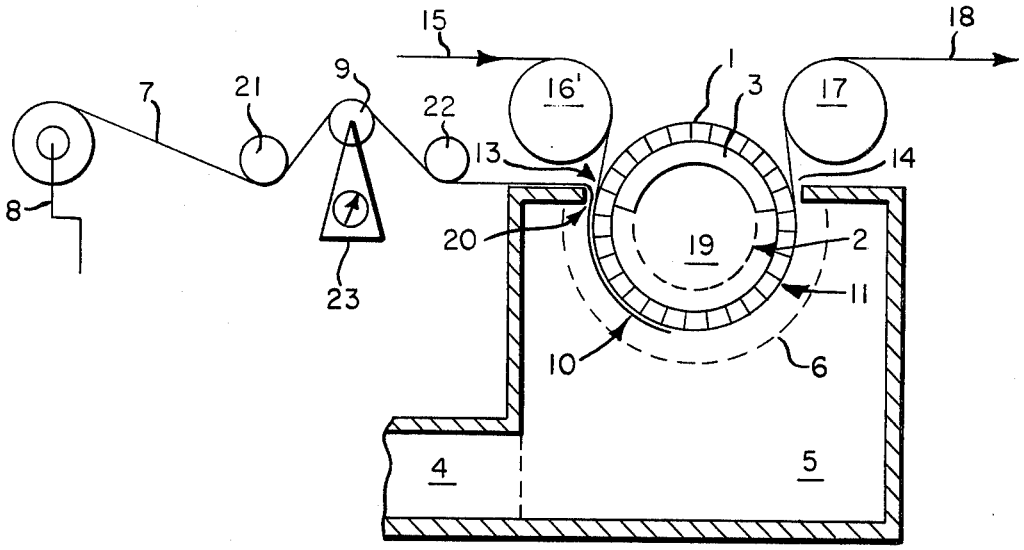
15
18
16'
17
1
3
7
21
9
22
13
14
8
20
19
2
11
23
10
6
4
5

APPARATUS FOR CONTINUOUS HOT AIR BONDING A NONWOVEN WEB

BACKGROUND OF THE INVENTION

This invention relates to a process and apparatus for preparing bonded nonwoven fabrics, and is more particularly concerned with improvements in thermal bonding of a web with hot air while conveying the web on a rotating cylindrical roll.

Steam-heated, smooth-faced cylindrical rolls have long been used for drying textile fabrics or paper webs. A recent improvement is to convey the wet web on cylindrical rolls having pervicus surfaces and to remove the water by passing hot air through the web. An illustration of such a flow-through dryer is found in Bryand et al. U.S. Pat. No. 3,345,756 dated Oct. 10, 1967.

A flow-through dryer can be adapted to thermally bond webs of thermoplastic filaments. The filaments are heated to the bonding temperature by passing air at a sufficiently high temperature through the web and the pervious surface of the roll into a vacuum zone within the roll. Flat, non-puckered products can be prepared by maintaining the web under high tension, but this results in unacceptably stiff and machine-directional properties. These undesirable properties can be improved by using lower tensions but then the products have a puckered appearance. Puckering appears as ridges or random marble-like bubbles and is aesthically unacceptable for most textile fabric uses.

SUMMARY OF THE INVENTION

The present invention provides an improvement in the process for thermally bonding a nonwoven web of thermoplastic filaments by conveying the web on a rotating hollow cylindrical roll having a pervious surface and passing hot air through the web into the roll to heat the filaments to the bonding temperature. The improvement comprises restraining the web against the roll surface during bonding with a stationary porous fabric under pressure developed by flow of the hot air through the fabric. The fabric has one end free and is held stationary under tension, the length of the fabric in contact with the web and the characteristics of the fabric preferably being selected to provide a tension of 0.018 to 0.54 kilograms per centimeter of fabric width.

The invention provides for elimination of undesirable puckering and, surprisingly, results in smooth products with satisfactory drapeability without causing objectionable property directionality. Beneficial effects of the stationary porous fabric are thought to result from a combination of increased restraint during bonding and an ironing effect on the web surface contacted by the stationary fabric.

The stationary fabric is preferably composed of yarns of polytetrafluoroethylene filaments or glass core filaments coated with a polytetrafluoroethylene sheath. The fabric preferably has an air permeability of 30 to 300 $cm^3$ per second per $cm^2$ when measured as described subsequently.

The process is especially useful when the web is composed of polyethylene terephthalate matrix filaments plus ethylene terephthalate/isophthalate (80/20) copolymer filaments.

The invention provides an improved apparatus for thermally bonding a web of thermoplastic filaments. The improvement comprises a stationary porous fabric for restraining the web against the roll surface under pressure developed by flow of hot air through the fabric. One end of the fabric is free and the fabric is held stationary by tension means located prior to contact of the fabric with the web on the roll. The tension means preferably includes fabric supply means for adjusting the length of fabric in contact with the web on the roll. The tension means preferably includes a pressure sensing roll and means for measuring tension on the fabric. The tension means preferably provides for a tension of 0.018 to 0.54 kilogram per centimeter of fabric width.

BRIEF DESCRIPTION OF THE DRAWING

The drawing is a schematic cross-sectional side view of the apparatus of this invention.

DETAILED DESCRIPTION

Bonding is accomplished on pervious cylindrical roll 1 of the drawing. The cylindrical surface of the roll is preferably composed of a screen-covered honeycomb structure and an outer screen with finer holes. The roll is journalled by a means not shown to rotate in a counterclockwise direction. Hot air is supplied through entrance conduit 4 and is distributed through enclosure 5 and perforated distribution plate 6. The hot air then passes through the screen-covered honeycomb surface of roll 1 to vacuum zone 19 located inside the roll. The cover screen is coated with polytetrafluoroethylene to minimize sticking. Hot air is exhausted through the ends of the roll via exit conduit 2. The air which is withdrawn from exit conduit 2 is heated and recycled (by means not shown) and the reheated air enters again through conduit 4. The upper section of the roll is closed by baffle 3 which is stationary. The inside surface of the honeycomb section moves along the surface of this baffle during rotation.

A porous pressing sheet 7 is provided and adjusted by sheet supply means 8. The supply means may be a hand-driven reel or a motorized reel which is provided with a stopping means such as a brake or clutch to hold the pressing sheet in a fixed position during normal operation after preliminary adjustment. The supply means may be used also to quickly remove and replace the pressing sheet when it has become worn or filled with melted binder material. The porous pressing sheet 7 is threaded around idler rolls 21, 9 and 22. The center roll 9 of this trio is a pressure sensing roll and is mounted on a tension indicator 23. The tension range is 0.018 to 0.54 kg./cm. of fabric width.

In starting up the hot air bonder the pressing sheet 7 is fed through opening 20 and is allowed to follow roll 1 partially through the enclosure 5 and is then held at a fixed position. It will be noted in FIG. 1 that a portion of the fabric 10 covers the leading portion of the honeycomb roll 1 while a portion 11 of the honeycomb roll remains uncovered. When all other factors are constant, the amount of compressional force applied to the nonwoven web is determined by the proportion of the roll which is covered.

The consolidated web 15 is fed over idler rolls 16 through the nip 13 formed by the pressing fabric 7 and the honeycomb roll 1. Hot air from plenum 5 passes through both the pressing sheet 7 and the consolidated web and is exhausted through vacuum zone 19. The nonwoven web is, therefore, held tightly against the surface of the honeycomb roll and is pressed against the roll by means of the porous pressing sheet 7. Finally the nonwoven sheet passes out of the hot air enclosure 5 into the surrounding atmosphere and passes over idler roll 17. The resulting bonded sheet 18 is then forwarded to a wind-up device or other processing equipment (not shown). The lips 14 and 20 of the enclosure may be provided with seals to avoid loss of hot air. Further, the loss of hot air can also be avoided by balancing the supply and exhaust air flows.

The pressing sheet is preferably a porous fabric which has a Frazier air permeability of 30 to 300 cm.$^3$ per sec. per cm$^2$ at a pressure of 12.7 mm. of water. Sheets with porosities much lower than 30 are unsatisfactory because such sheets prevent adequate supply of hot air from reaching the nonwoven web in the required time. Sheets with porosities over 300 cm.$^3$/sec./cm.$^2$ do not provide adequate pressure or tension development, without excessively long fabric. Both warp and filling yarns should be thermally stable at bonding temperatures to avoid distortion (puckering) or shrinkage of the pressing sheet at the operating temperature. For example, when used to bond a blend of polyethylene terephthalate and polyester copolymer filaments, the yarns in the pressing sheet should be stable at 250° C. A low coefficient of friction is desirable for the surface of the pressing sheet; the yarn filaments may be composed completely of polytetrafluoroethylene or may be composed of high melting core filaments coated with a polytetrafluoroethylene sheath. Glass core filaments are especially preferred since they are more resistant to abrasion than the other filaments tested.

From mechanics it is known that the tension required to move one object over another is directly proportional to the compressional force between them. For this reason, the tension generated by the pressing sheet provides a convenient way for measuring and adjusting compressional force. The relationship of various factors of the process may be explained by reference to Formula I $$T = \Delta P\, r\, (e^{fs/r} - 1) \qquad \text{I.}$$

where:

$T$ is the maximum tension observed (kg./cm. of fabric width)

$\Delta P$ is the pressure drop through the pressing sheet (kg. per cm.$^2$) determined at air velocity and temperature used in bonding.

$f$ is the coefficient of friction of pressing sheets at operating temperatures $r$ is the radius of the hot porous roll (cm.), $s$ is the distance occupied by the pressing sheet along the circumference of the hot porous roll (cm.), and $e$ is the base of the natural logarithm.

Pressing sheets having a coefficient of friction of 0.4 to 0.7 are suitable for bonding a nonwoven web of polyethylene terephthalate (spontaneously elongatable) matrix filaments and polyethylene terephthalate/isophthalate (80/20) copolymer filaments. In designing a suitable apparatus the various factors of the equation are considered. For example, the value of $s/r$ is adjusted to about 0.4 to 4.0 to keep T and $\Delta P$ within easily achieved limits.

The tension measuring means consists of pressure sensing roll 9 mounted on a pillow block (not shown) which in turn is mounted on tension indicator 23. The indicator may be an air operated unit of the type provided by Mount Hope Machinery Co., 15 Fifth Street, Taunton, Mass. Air pressure differences as low as 0.07 kg./cm.$^2$ (1 lb./in.$^2$) are accurately indicated once the transmitter is adjusted to zero load and calibrated for the particular chosen pressure range.

Table I provides details of a number of useful constructions for fabric pressing sheets. Air Permeability of the pressing sheet is determined by the Frazier method described in ASTM-D737-69. The test is run with room temperature air (25° C.) with pressure equivalent to 12.7 mm. of water. Permeability is expressed as cm.$^3$ per sec. per cm.$^2$.

TABLE I

Fabric Construction for Pressing Sheets

| Item No. | Filament Composition | Fabric Weight, g/m$^2$ | Denier(a) Warp | Denier(a) Filling | Ends/cm | Picks/cm | Weave Pattern | Air Permeability cm.$^3$/sec./cm$^2$ |
|---|---|---|---|---|---|---|---|---|
| 2 | Polytetrafluoroethylene | 281 | 1200 | 1200 | 29.6 | 28.4 | Plain | 37 |
| 3 | " | 271 | 1200 | 1200 | 29.2 | 28.4 | Plain | 42 |
| 4 | " | 553 | 1200 | 1200 | 59.0 | 28.4 | Plain | 77 |
| 5 | " | 359 | 1200 | 1200 | 21.3 | 15.8 | Twill (x) | 90 |
| 7 | Polytetrafluoroethylene sheath/glass core | 373 | 1560 | 1560 | 7.8 | 12.6 | Plain | 51 |
| 8 | " | 576 | 1560 | 1560 | 6.3 | 7.8 | Plain | 76 |
| 9 | " | 498 | 1560 | 1560 | 4.7 | 5.5 | Plain | 270 |

(a) Total Yarn Denier Shown - Approx. 7.0 denier per filament

EXAMPLE

A. A consolidated web of polyethylene terephthalate matrix filaments and ethylene terephthalate/isophthalate (80/20) copolymer filaments is bonded while conveyed on a 24-inch diameter, hollow cylindrical roll and covered with a stationary porous fabric as illustrated in the drawing. The roll has a pervious surface and a suction zone provides an air flow of 500 feet per minute into the roll. Hot air is supplied at 215° C. The stationary porous fabric is as described in Item No. 5 of Table I. The length of the suction zone covered by the fabric is 35 inches. The consolidated web weighs 2.4 ounces per square yard, is fed at 31 yards per minute, the residence time in the hot air flow is 2.4 seconds, and the bonded product is wound up at 33.5 yards per minute to maintain a low tension in contact with the roll. Product properties are given in Table II. A smooth product having good drapeability, as indicated by the bending length, is obtained. It is free of puckering.

B. For comparison, the above run is repeated without the stationary porous fabric, under otherwise identical conditions. Properties of comparison product (B) are given in Table II. The product is puckered.

C. For comparison, run (B) is repeated but the product is wound up at 40 yards per minute to maintain a high tension in contact with the roll. Properties of comparison product C. are given in Table II. The product is free from puckering but has poor drapeability, as indicated by the bending length measurements. Machine direction properties greatly exceed those in the cross direction.

TABLE II

| PRODUCE PRODUCT PROPERTIES | | | |
|---|---|---|---|
| Product | A | B | C |
| Unit weight, oz./yd.$^2$ | 2.31 | 2.36 | 2.34 |
| Bending length, cm. | | | |
| Machine direction | 4.2 | 4.6 | 7.3 |
| Cross direction | 2.8 | 3.9 | 3.0 |
| Strip tensile, lb./in. | 7.6 | 8.6 | 10.0 |
| Tongue tear, lb. | 5.9 | 6.2 | 4.8 |

I claim:

1. In an apparatus which includes a rotating hollow cylindrical roll having a pervious surface for conveying a web and means for passing hot air through the web and into the roll over the distance the web is conveyed on the roll; the improvement for thermally bonding a web of thermoplastic filaments which comprises a stationary porous fabric for restraining the web against the roll surface for a distance of about 35 inches under pressure developed by flow of the hot air through the fabric, the fabric having one end free and being held stationary by tension means which includes fabric supply means for adjusting the length of fabric in contact with the web on the roll, a pressure sensing roll located between the supply means and contact of the fabric with the web on the roll, and means for measuring tension on the fabric.

* * * * *